US005255055A

United States Patent [19]

Mahoney

[11] Patent Number: 5,255,055

[45] Date of Patent: Oct. 19, 1993

[54] REPRODUCTION APPARATUS HAVING A PLURALITY OF NON-IMAGING PORTION DETECTORS

[75] Inventor: Gregory P. Mahoney, Fairport, N.Y.

[73] Assignee: Eastman Kodak Company, Rochester, N.Y.

[21] Appl. No.: 812,093

[22] Filed: Dec. 23, 1991

[51] Int. Cl.[5] ..... G03G 21/00

[52] U.S. Cl. ..... 355/208; 355/212

[58] Field of Search ..... 355/212, 213, 208, 209, 355/210, 211

[56] References Cited

U.S. PATENT DOCUMENTS

| | | | |
|---|---|---|---|
| 4,025,186 | 5/1977 | Hunt, Jr. et al. | 355/212 |
| 4,110,033 | 8/1978 | Ophey | 355/212 X |
| 4,556,311 | 12/1985 | Tagoku | 355/212 |
| 4,596,457 | 6/1986 | Peeters et al. | 355/212 X |
| 4,662,739 | 5/1987 | Sakai et al. | 355/200 X |
| 4,860,054 | 8/1989 | Higuchi | 355/210 X |
| 4,914,477 | 4/1990 | Young et al. | 355/208 |

FOREIGN PATENT DOCUMENTS

| | | | |
|---|---|---|---|
| 0113951 | 7/1983 | Japan . | |
| 0015966 | 1/1984 | Japan | 355/212 |
| 0064374 | 4/1985 | Japan | 355/212 |

*Primary Examiner*—A. T. Grimley
*Assistant Examiner*—Robert Beatty
*Attorney, Agent, or Firm*—Lawrence P. Kessler

[57] ABSTRACT

A reproduction apparatus such as a copier or printer has an endless imaging member such as a flexible web which has a splice and a number of processing stations. The imaging member is divisible into a plural number of imaging portions as well as a non-imaging portion about and including the splice. The imaging member is movable in the copier or printer about a fixed path, and the processing stations are mounted at fixed points along the fixed path. To significantly increase the productivity of the copier or printer, a plural number of sensors are mounted spaced from each other about the fixed path for quickly sensing the splice for use in registering the imaging portions of the imaging member to the processing stations.

9 Claims, 4 Drawing Sheets

REPRODUCTION APPARATUS HAVING A PLURALITY OF NON-IMAGING PORTION DETECTORS

BACKGROUND OF THE INVENTION

1. Field of the Invention

This invention relates to electrostatographic reproduction apparatus such as copiers and printers, and more particularly to such a copier or printer that includes an imaging member having imaging and non-imaging portions.

2. Description Relative to the Prior Art

Electrostatographic reproduction apparatus for producing copies of an original document are well known. Such copies typically are produced on suitable receiver sheets through a repeatable process that normally includes the steps of (1) using electrostatic charges at fixed first and second stations in some manner to form a latent image on the surface of an imaging or image-bearing member; (2) developing the latent image at a third station with developer material that includes toner particles; (3) transferring the developed image at a fourth station from the imaging member to a suitable receiver sheet for subsequent fusing; and (4) cleaning the image-bearing surface of the imaging member thereafter at a fifth station by removing residual toner and other particles therefrom.

In such reproduction apparatus in which the imaging member is repeatedly reused, ordinarily the imaging member has an endless shape for example in the form of a drum or of a flexible web. The endless flexible web form as disclosed for example in commonly assigned U.S. Pat. No. 4,025,186, issued May 24, 1977 in the name of Hunt, Jr. et al. has certain advantages and disadvantages relative to the drum form. Among the advantages is the fact that such a flexible web can be disposed in a flat orientation along one portion thereof, and in a curved orientation along another portion thereby facilitating placement of operating stations thereabout. More importantly, the flexible web form of an imaging member can allow for multiple images to be in the formation process at any given time and still retain some compactness in overall machine size.

Among the disadvantages, however, is the presence of a web splice, that is where two ends of the web material usually have been splice-jointed together in order to form its endless shape. Unfortunately, the portion of the web including and immediately adjacent either side of the splice is not suitable for forming quality images, and so is regarded as a non-imaging area. Accordingly, in order to avoid forming images on such a non-imaging area, it is conventional to move the web about its path in the reproduction apparatus until the splice is detected usually by a single detector located at a set point selected so that the imaging portion of the web is then in a position to run in proper registration with the fixed electrostatographic process stations of the apparatus as described above.

Unfortunately, moving the imaging member as such wastes valuable time especially in conventional large and high volume reproduction apparatus which each have a long flexible web imaging member. Such a long imaging member usually is divisible into a plural number of imaging portions, and valuable time and productivity is lost especially when running short jobs if the long web has to be moved as described with every job in order to achieve proper registration thereof at the single splice set point.

SUMMARY OF THE INVENTION

In accordance with the present invention, a high productivity reproduction apparatus is provided including an endless imaging member that has a plural number of imaging portions as well as a non-imaging portion. The imaging member as mounted in the reproduction apparatus has a fixed path, and is movable along such path.

The reproduction apparatus also includes (a) means located at a first station along the fixed path for forming a latent image on one of the plural number of imaging portions, (b) means located at a second station along the fixed path for developing the latent image, and (c) means located at a third station along the fixed path for transferring the developed image onto a receiver sheet. Furthermore, the reproduction apparatus includes indicating means formed within the non-imaging portion of the movable imaging member for marking such non-imaging portion, and a plural number of sensing means located spaced from each other at a plural number of predetermined sensing points along the fixed path for sensing the passing of the indicating means by any of such predetermined sensing points.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic reproduction apparatus are well known, the present description will be directed in particular to elements forming part of or cooperating more directly with the present invention. Apparatus not specifically shown or described herein are selectable from those known in the prior art.

Figure 1:
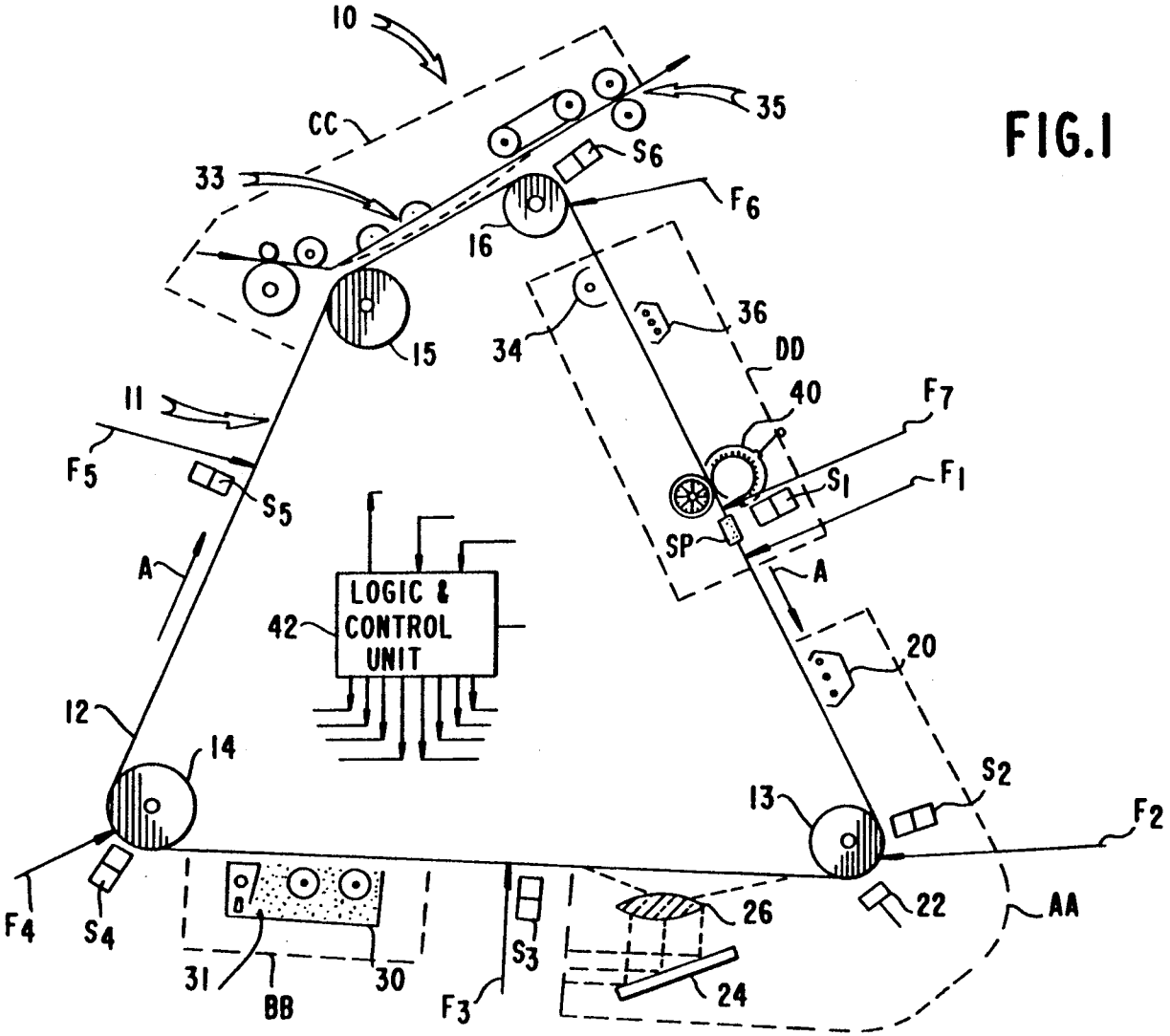
FIG. 1 is a schematic of an electrostatographic reproduction machine such as an electrophotographic copier embodying the present invention.

Referring now to FIG. 1, an electrostatographic reproduction machine such as an optical copier is shown generally as 10. The present invention will be described with reference to a copier but it is understood that it is equally applicable to other reproduction machines such as printers and the like. As shown, the reproduction apparatus 10 includes an endless image-bearing member 11 which has a frontside image-bearing surface 12. The imaging member 11 for example is a flexible web trained along a fixed path about a series of rollers 13 through 16 for movement in the direction, for example, of the arrow A. One of the rollers, such as the roller 13, can be a drive roller, suitably driven by a conventional drive (not shown) for repeatedly moving the imaging member 11 through a series of electrostatographic process stages shown as AA, BB, CC and DD. Although the member 11 is shown as an endless flexible web trained about the series of rollers, it should be understood that other forms of image-bearing members having a non-imaging portion thereon can also be used.

As shown in FIG. 1, clean and charge-free portions of the image-bearing member 11 for example, initially move through the stage AA where electrostatic charges and/or light, are used in one manner or another (as is well known in the art) to electrostatically form latent images of an original document on the surface 12. Typically, the stage AA includes a first station where contamination sensitive components such as a primary charger 20 or other charge depositing component (not shown) are located at selected fixed positions. The electrostatic image of an original document thus can be formed on the surface 12, for example, by charging the surface 12 at the first station using the primary charger 20, and then imagewise discharging portions of such surface at a second station using for example an electronic printhead 22 and/or an optical system. A typical optical system has a light source (not shown) that illuminates a sheet of the original document on a platen such that the light rays reflected from the sheet are in turn reflected by a mirror shown as 24, through a lens shown as 26, to a portion of the surface 12 thereby image-wise exposing or imaging such portion.

The imaged portion of the surface 12 next moves with its member 11 to stage BB where the latent image thereon is developed, that is, is made visible with charged particles of toner. For such development, the stage BB normally includes a third station where a development apparatus 30 which contains a developer material 31 including the toner particles is used. As is known, such developer material may comprise the toner particles only, or a mixture of oppositely charged magnetic carrier particles and toner particles. During such development of the latent image at the apparatus 30, the toner particles of the developer material 31 transfer to the image-bearing surface 12 and there adhere to the electrostatically formed latent image, thereby making such image visible.

After such development, that portion of the image-bearing surface 12 carrying the toner developed or visible image thereon, next moves to the stage CC. Stage CC usually includes a fourth station where image transfer means shown as 33 are used to transfer the visible toner image from the surface 12 to a suitable receiver sheet. The receiver sheet is fed in registration to the means 33 along a sheet travel path. Typically, such transfer is effected electrostatically as well as by contact and pressure within a transfer nip. After such image transfer, the copy sheet then travels to a fusing station 35, as shown, where the image is permanently fused to the receiver sheet forming a copy. Meanwhile, the member 11 moves on along its fixed path about the series of rollers 13 through 16 back towards the initial stage AA to begin another imaging cycle.

On leaving the transfer station at the means 33, each portion of the surface 12, on which a toner image has been formed and transferred as described above, ordinarily will be contaminated with residual charges as well as with residual particles, principally residual toner particles. To ensure the continued production of high quality images and copies during subsequent cycles of the repeatable imaging process of the copier 10, it is necessary therefore to effectively clean, that is, to effectively remove such residual toner particles from each such used portion of the surface 12. Accordingly, such cleaning is carried out at stage DD where apparatus or devices are located for removing the residual charges and particles. As shown for example, the residual charges can be removed by a discharge lamp 34 and/or neutralized by a corona 36, and the residual toner particles can be removed by a cleaning apparatus 40.

As is known in the art, the reproduction apparatus 10 may further include a logic and control unit (LCU) shown as 42 which is appropriately connected to, and is programmable for controlling the function and operation of each working component of such apparatus 10 and is responsive to signals from one or more encoders that sense indicia on the endless web 11 to synchronize the various operations of the operating stations.

Figure 2:
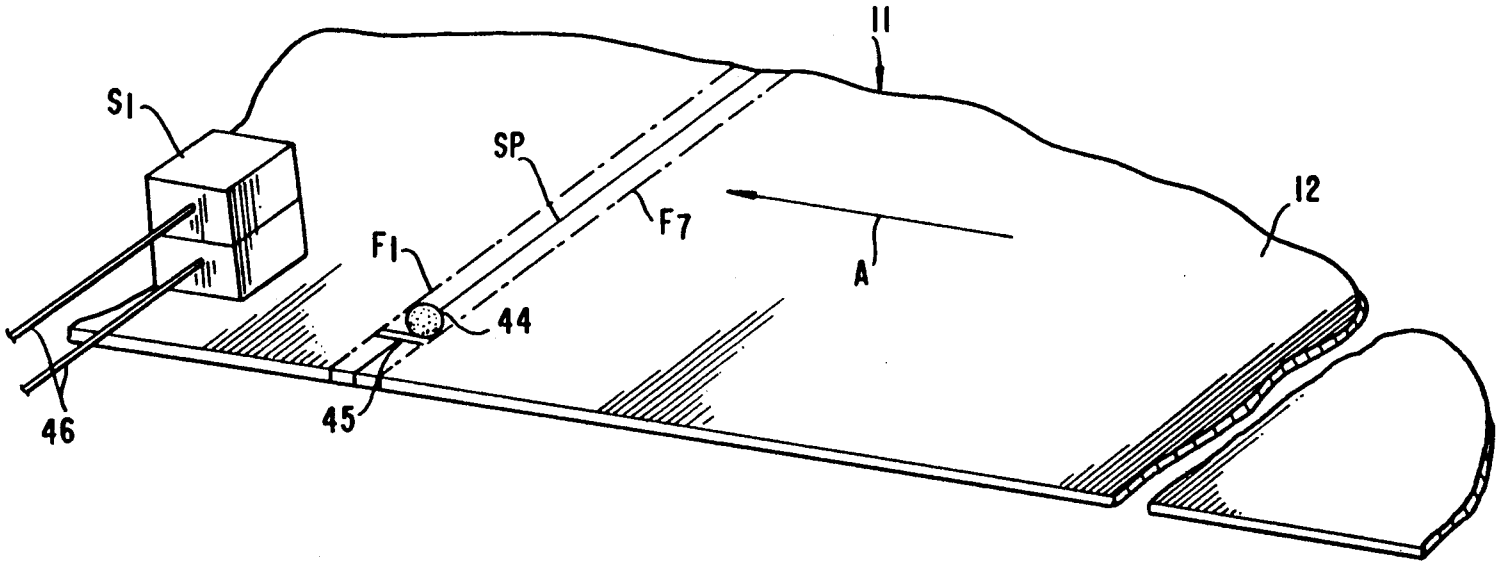
FIG. 2 is an enlarged perspective view of a section of the endless imaging web member of the copier of FIG. 1 showing one of the splice detectors of the present invention.

Referring now to FIGS. 1–4, the endless imaging web member 11 of the present invention is a relatively long web and includes a single splice shown as SP. The splice SP is where two ends of the web material has been splice-joined together in order to form its endless shape 11. The splice SP as illustrated is exaggerated over its actual relative appearance so as to make it stand out in the midst of all the other features of the invention. Elsewhere on the imaging member 11, away from the splice SP, the imaging member 11 has or is divisible into a plural number N1 of imaging portions or image frames which are shown lying between indicating arrows $F_1$, $F_2$, $F_3$, $F_4$, $F_5$, $F_6$ and $F_7$ (FIGS. 1 and 2). Each imaging portion or image frame as such has a predetermined length for occupying a distance of the fixed path of the web 11. The imaging member 11 also includes a non-imaging portion consisting of a relatively narrow band of the surface 12 immediately adjacent to each side of the splice SP. As shown in FIGS. 1 and 2, this non-imaging portion lies clockwise between the indicating arrows $F_7$ and $F_1$. As shown, the imaging member 11 of the present invention has six (6) imaging portions or frames, for example, which lie clockwise between adjacent indicating arrows from $F_1$ to $F_7$. There are, of course, no physical and actual dividing marks between any of such image frames, instead the section of the web clockwise between the indicating arrows $F_1$ through $F_7$ is uniform and continuous with a continuous portion thereof occupying a distance along the fixed path of the member 11 relative to each of the process stations described above when the member 11 is properly registered along such path. As such, six (6) images can be produced consecutively at spaced locations on the continuous section, one per each such portion or image frame, when the member 11 is fully imaged during one complete revolution around the fixed path.

For such full imaging, it is necessary to start out with the imaging web 11 in a properly registered position as shown for example in FIG. 1. In such a registered position, the imaging portions or frames each occupy a distance or portion of the fixed path so as to each be in proper working relationship relative to each one of the processing stations mounted fixedly along such distance of the path as described above, and more importantly, the non-imaging portion including the splice SP occupies a distance or portion of the fixed path such that no image will be formed over the splice or over such non-imaging portion. As shown, such registration is achieved at a moment when a sensor, for example $S_1$, which is mounted fixedly at a first registration point along the fixed path of web 11, senses the splice SP as passing by such sensor $S_1$ at such moment. As shown in FIG. 2, indicating means such as reflective mark 44 may be formed preferably within the non-imaging portion between arrows $F_7$ to $F_1$ (clockwise direction FIG. 1) over the splice SP such that the mark 44 will move with the surface 12 into sensing relationship with the sensor $S_1$. The mark 44 may also be formed at a predetermined spaced position from the splice for sensing and control accordingly in order to properly locate the splice. The sensor $S_1$, like other components of the reproduction apparatus 10 is connected for example by means shown as 46 to the logic and control unit (LCU) 42. As such, an output signal from the sensor $S_1$ indicating the momentary sensing of the presence of the splice SP at the sensor $S_1$ can be fed to the LCU 42 for use in initiating and controlling the functioning and operation relative to imaging member 11 of the process stations as described above. Although the indicating means 44 for marking the non-imaging portion is described as a reflective mark, it is understood that other appropriate types of indicia or marks such as a perforation shown as 45 can also be used cooperatively with an appropriate sensor for sensing such a mark.

Unfortunately, the imaging member 11 is not always fully imaged each revolution. Instead, the number of copies and hence the number of images that are produced each revolution of the web 11 of course varies for each copying job being run on the apparatus 10. Rarely is the number of such images or copies run such that the splice SP, when started at the registration position for example at the sensor $S_1$, will end up exactly at such same registration position at $S_1$. In fact, after each such displacement, the splice SP on web 11 could be expected to require moving anywhere from a minimum of 0° to a maximum of 359° around the fixed path in order to return it for sensing and registration again for example at the single sensing point at $S_1$. On the average, the web 11 as such can be expected to move about 180° along the fixed path each time such re-registration is required (which is frequent).

However, in accordance with the present invention, the reproduction apparatus 10 includes a plural number $N_2$ of sensors similar to $S_1$ and shown additionally as $S_2$, $S_3$, $S_4$, $S_5$ and $S_6$ which each function in exactly the same manner as the sensor $S_1$. Preferably, in the apparatus 10 the processing stations as described above are located along the fixed path of the member 11 such that when an image frame of the web 11 is properly registered under each station, there is room or allowance upstream of each such station (relative to movement of the web 11) for the non-imaging portion $F_7$ to $F_1$ (clockwise). The plural number $N_2$ of sensors $S_1$ to $S_6$ is preferably the same as the number $N_1$ of imaging portions. Accordingly therefore the sensors $S_1$ to $S_6$ should be located at predetermined points along the fixed path, and upstream of each such processing station. As such, each sensor $S_1$ to $S_6$ will be located upstream of each portion or distance that will be occupied by an imaging portion or image frame when the member 11 is registered in relation to each such station. Each sensor $S_1$ to $S_6$ is thus located at a point so as to be capable of sensing the splice SP at such point when the frame $F_1$–$F_2$ for example is registered relative to the next downstream station, and such that the rest of the other imaging portions or image frames are also registered with respect to the other processing stations.

As shown, the plural number $N_2$ of sensing means $S_1$ to $S_6$ are located as such spaced from each along the fixed path so as to be capable of sensing the passing at each such point of the indicating mark 44, and hence of the splice SP. As connected to the LCU 42, each of the sensors $S_1$ to $S_6$ forms part of a control means for controlling the registration of the imaging portions or image frames of the web 11 relative to the processing stations of the reproduction apparatus 10. Such control means may for example include means for starting, moving and stopping the imaging member 11 along the fixed path in response to a signal from one of the sensors $S_1$–$S_6$.

Figure 3:
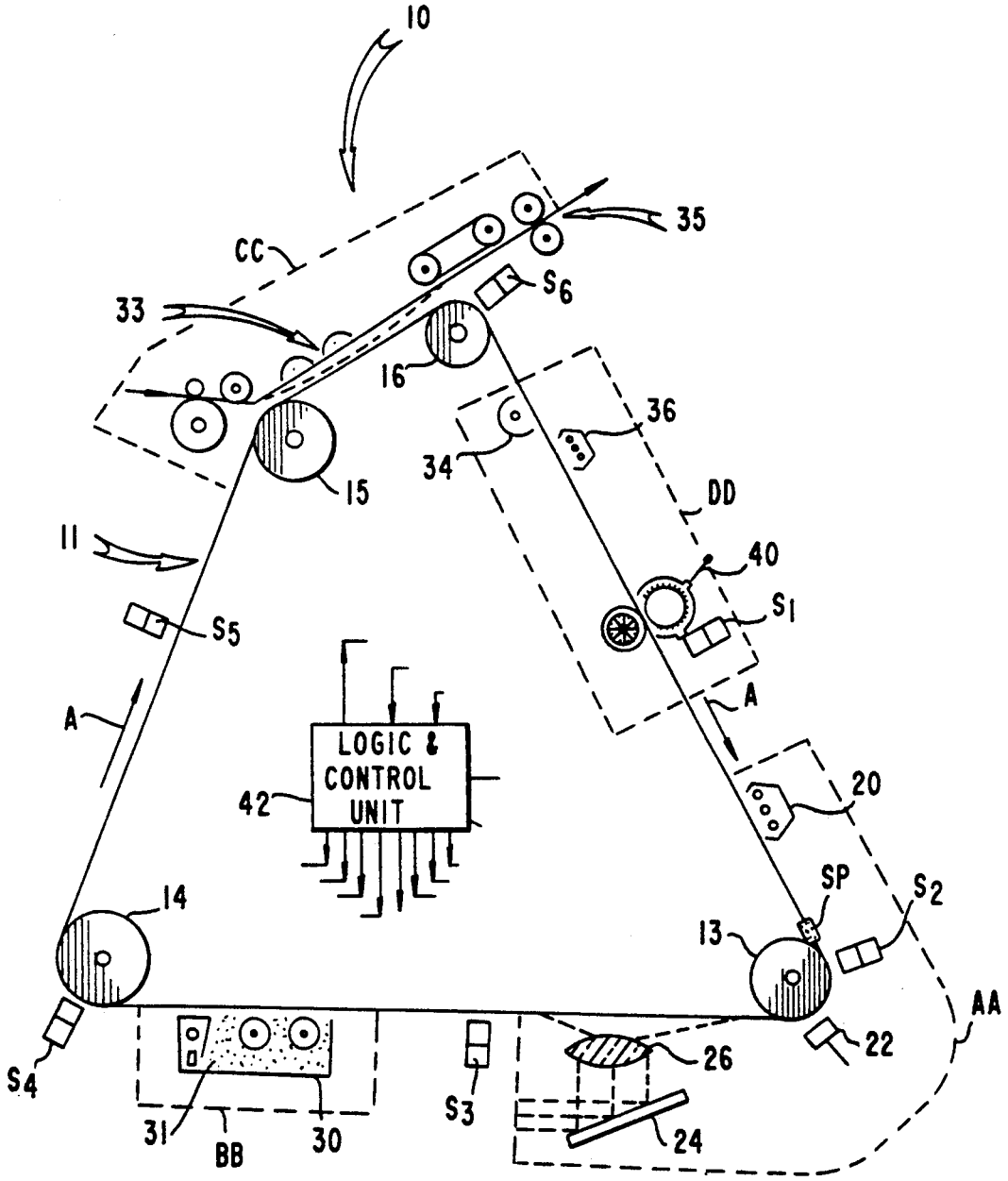
FIG. 3 is similar to FIG. 1 but shows the splice of the web member in a second position different from that of FIG. 1.
Figure 4:
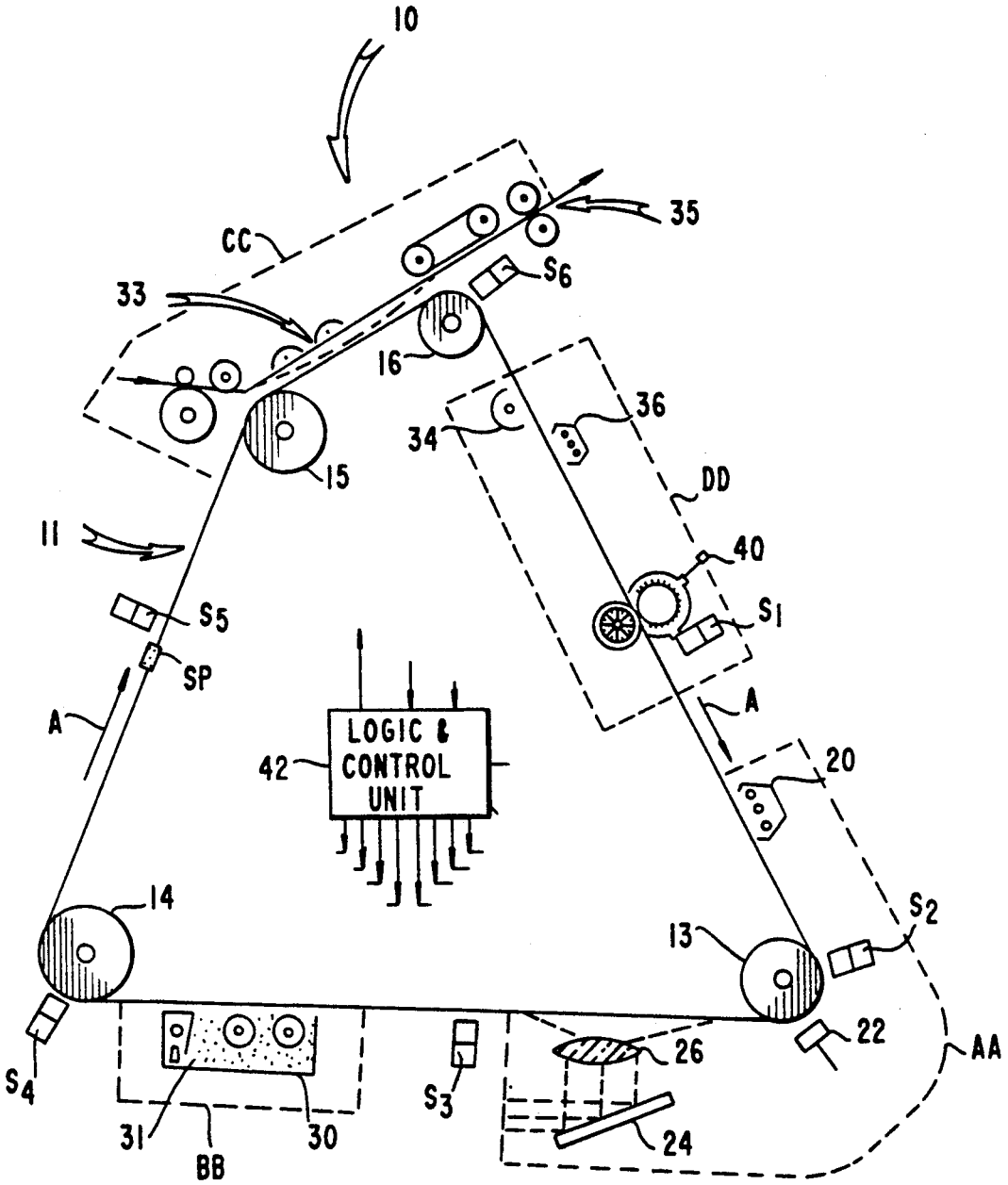
FIG. 4 is also similar to FIGS. 1 and 3 but shows the splice of the web member in a third position different from those of FIGS. 1 and 3.

As shown in FIGS. 3 and 4, the productivity of the apparatus 10 of the present invention is significantly increased because regardless of where the splice SP ends up in relation to a starting registration point, for example at $S_1$, at the end of one copying job or during a job interruption, re-registration of the imaging web 11 can be effectively accomplished with the splice moving anywhere from only 0° to a maximum of approximately 60° before being sensed and registered by one of the sensors $S_1$ to $S_6$. As such, the average required movement for such re-registration will be only about 30° around the fixed path. When the imaging member 11 only has to move such a short distance, at least the waiting time for a first copy is reduced for each job thereby increasing the productivity of the apparatus 10.

The invention has been described in detail with particular reference to a presently preferred embodiment, but it will be understood that variations and modifications can be effected within the spirit and scope of the invention.

What is claimed is:

1. An electrostatographic reproduction apparatus comprising:

(a) an endless imaging member having a fixed path and being movable along said fixed path, said imaging member having thereon a plural number $N_1$ of possible consecutive imaging portions as well as a non-imaging portion including an indicium in said non-imaging portion for identifying said non-imaging portion;

(b) means located at a first station along said fixed path for forming a latent image on one of said plural number $N_1$ of imaging frames of said imaging member;

(c) means located at a second station along said fixed path for developing such latent image;

(d) means located at a third station along said fixed path for transferring said developed image onto a receiver sheet; and (e) a plural number $N_2$ of sensing means located one after another and spaced from each other at a plural number of predetermined consecutive sensing points along said fixed path a distance apart substantially equal to the dimension of an image portion measured in a direction along said fixed path for sensing passage of said non-imaging portion indicating means through any of said sensing points.

2. The reproduction apparatus of claim 1 wherein said plural number $N_2$ of sensing means is equal to said plural number $N_1$ of imaging portions on said imaging member.

3. The reproduction apparatus of claim 1 wherein said imaging member is a spliced flexible web.

4. The reproduction apparatus of claim 3 wherein said non-imaging portion of said imaging member includes the splice of said web.

5. The reproduction apparatus of claim 4 wherein said indicating means includes reflective material.

6. An electrostatographic reproduction apparatus for producing copies of original images, the electrostatographic reproduction apparatus comprising:

(a) an endless imaging member having thereon a plurality $N_1$ of consecutive imaging portions and a non-imaging portion, said imaging member being movable through a fixed path;

(b) a plurality of image processing means located adjacent said fixed path for image-wise acting on said imaging member, said image processing means including:

(i) means for forming a latent image on said imaging member;

(ii) means for developing such a latent image; and (iii) means for transferring the developed image to a receiver sheet; and (c) control means for controlling the registration, along said fixed path, of said plurality of imaging portions of said imaging member relative to said plurality of image processing means, said control means including:

(i) indicating means for identifying the location along said path of said non-imaging portion of said imaging member; said indicating means being formed at a predetermined first position within said non-imaging portion of said imaging member;

(ii) a plurality of sensing means located one after another at predetermined positions all around said fixed path of said movable imaging member for sensing the passage at each said predetermined position of said indicating means, said respective sensing means of said plurality of sensing means being spaced apart of a distance substantially equal to the dimension of an image portion measured in a direction along said fixed path; and (iii) means for moving and stopping said imaging member along said fixed path in response to a signal output from one of said plurality of sensing means.

7. The reproduction apparatus of claim 6 wherein each one of said sensing means is located so as to be capable of sensing a common indicating means of said non-imaging portion.

8. The reproduction apparatus of claim 6 wherein said imaging portions of said imaging member lie to either side of said non-imaging portion in a continuous and uniformly unmarked section of said imaging member.

9. The reproduction apparatus of claim 7 wherein each one of said sensing means is located such that when it is sensing said common indicating means for said non-imaging portion, an imaging portion immediately downstream of said non-imaging portion is properly registered at a processing means located immediately downstream of the location of said sensing means.

* * * * *